US010858160B2

(12) United States Patent
Yang

(10) Patent No.: US 10,858,160 B2
(45) Date of Patent: Dec. 8, 2020

(54) THERMAL BOX

(71) Applicant: Quanzhou HG Electronics Development Co., Ltd., Fujian (CN)

(72) Inventor: Kongjun Yang, Fujian (CN)

( * ) Notice: Subject to any disclaimer, the term of this patent is extended or adjusted under 35 U.S.C. 154(b) by 568 days.

(21) Appl. No.: 15/834,062

(22) Filed: Dec. 7, 2017

(65) Prior Publication Data

US 2019/0177059 A1 Jun. 13, 2019

(51) Int. Cl.

| | |
|---|---|
| ***B65D 55/02*** | (2006.01) |
| ***B65D 81/38*** | (2006.01) |
| ***B65D 43/02*** | (2006.01) |
| ***B65D 45/24*** | (2006.01) |
| ***B65D 25/32*** | (2006.01) |
| ***E05B 17/20*** | (2006.01) |
| ***E05C 9/14*** | (2006.01) |
| ***E05C 3/06*** | (2006.01) |
| ***E05B 65/52*** | (2006.01) |

(52) U.S. Cl.

CPC ..... *B65D 55/02* (2013.01); *B65D 25/32* (2013.01); *B65D 43/0202* (2013.01); *B65D 45/24* (2013.01); *B65D 81/3813* (2013.01); *B65D 2543/00194* (2013.01); *B65D 2543/00296* (2013.01); *E05B 17/2053* (2013.01); *E05B 65/5269* (2013.01); *E05B 65/5276* (2013.01); *E05C 3/06* (2013.01); *E05C 9/14* (2013.01); *Y10T 292/0871* (2015.04); *Y10T 292/0911* (2015.04); *Y10T 292/0917* (2015.04); *Y10T 292/0928* (2015.04); *Y10T 292/0949* (2015.04); *Y10T 292/216* (2015.04)

(58) Field of Classification Search

CPC ..... E05B 17/2053; E05B 65/5276; E05B 65/5269; E05C 3/06; E05C 9/14; Y10T 292/216; Y10T 292/0917; Y10T 292/0871; Y10T 292/0911; Y10T 292/0928; Y10T 292/0949; Y10T 16/52; B65D 55/02; B65D 45/24; B65D 25/32; B65D 81/3813; B65D 43/0202; B65D 2543/00296; B65D 2543/00194

USPC ..... 220/324, 4.22, 4.23, 4.24, 314

See application file for complete search history.

(56) References Cited

U.S. PATENT DOCUMENTS 2,635,910 A * 4/1953 Celeste ..... E05C 19/14 292/247

2,893,771 A * 7/1959 Claud-Mantle ..... B65D 45/24 292/113

(Continued)

*Primary Examiner* — Kristina R Fulton

*Assistant Examiner* — Faria F Ahmad

(74) *Attorney, Agent, or Firm* — Prakash Nama; Global IP Services, PLLC

(57) ABSTRACT

The present invention discloses a thermal box comprising a body; the body comprises a box body, a box cover and locking devices provided on a front side and a rear side of the body respectively; the snap fastening seat is fixed on the box body; two extended lugs are provided on the box cover; the snap fastening seat is provided with a pivot seat between the two extended lugs; two mounting lugs are provided on a top side of the snap fastening member; the two extended lugs are positioned between the two mounting lugs and interconnected thereto via a rotating shaft to rotate inwards and outwards; a fastening structure which fastens by pressing inwards and unfastens by pulling outwards is provided on the inner side of the snap fastening member and the snap fastening seat.

7 Claims, 4 Drawing Sheets

(56) References Cited

U.S. PATENT DOCUMENTS 3,030,137 A * 4/1962 Tomkinson ..... E05C 19/14 292/113
3,584,906 A * 6/1971 Budzyn ..... E05C 19/14 292/247
4,023,840 A * 5/1977 Souza ..... E05C 19/14 292/113
4,326,739 A * 4/1982 Schlueter ..... E05C 19/14 292/247
4,331,257 A * 5/1982 Taschner ..... A61L 2/26 220/214
4,782,673 A * 11/1988 Castelli ..... E05C 19/14 292/113
5,024,471 A * 6/1991 Kahl ..... E05B 65/0053 220/315
5,127,684 A * 7/1992 Klotz ..... E05C 19/14 292/113
5,193,706 A * 3/1993 Hanna ..... B25H 3/02 220/324
5,351,509 A * 10/1994 Visenzi ..... A45C 13/18 70/159
5,630,507 A * 5/1997 Baker ..... A61F 17/00 206/1.5
6,179,350 B1 * 1/2001 Ely ..... E05C 19/14 292/113
6,234,723 B1 * 5/2001 Thalmayr ..... B65G 51/06 220/219
6,527,309 B1 * 3/2003 Gaydos ..... E05B 65/5276 292/128
6,547,293 B1 * 4/2003 Cheng ..... E05C 19/14 292/113
7,370,891 B1 * 5/2008 Schmitt ..... E05B 17/2053 292/113
7,909,371 B1 * 3/2011 Mihlbauer ..... A01K 63/006 292/80
8,297,464 B2 * 10/2012 Grenier ..... A45C 13/1084 220/326
8,328,247 B2 * 12/2012 Tonelli ..... A45C 13/1084 292/194
8,807,622 B2 * 8/2014 Fukumoto ..... E05F 1/1016 296/37.12
2005/0001435 A1 * 1/2005 Parker ..... A45C 13/1084 292/116
2006/0042897 A1 * 3/2006 Sanderson ..... E05B 65/5276 190/120
2011/0139777 A1 * 6/2011 Sosnovsky ..... B65D 21/0228 220/23.83
2013/0043250 A1 * 2/2013 Kreidler ..... A61L 2/26 220/324
2014/0251998 A1 * 9/2014 Kinskey ..... E05C 19/10 220/324
2014/0319147 A1 * 10/2014 Horovitz ..... B65D 43/0202 220/324

* cited by examiner

THERMAL BOX

BACKGROUND OF THE INVENTION

The present invention relates to thermal box technology and more particularly pertains to a thermal box.

Conventional thermal box generally comprises a box body and a box cover movably covered on the box body. The box body and the box cover are made of heat-insulated material. In terms of the uses of thermal boxes, thermal boxes are used for keeping food cold or hot so that food maintains its original state. Therefore, thermal boxes are applied in daily life extensively.

Thermal box may be used for keeping food hot. For example, with the enhancement of living standard and significant development of the food industry, takeaway has become a new profit growth point of the food industry. Enjoying various foods at home with family has become a healthy and natural lifestyle which has become more common in overseas developed countries and also has become more popular locally. When the takeaway food which is hot has to be transported to the client, the food has to travel for a certain distance. If the thermal effect of the thermal box is not good enough, food temperature is low and the taste of food would be jeopardized and the food would be unsavory, thereby affecting people's mood.

However, in existing thermal box, the box cover and the box body are generally fastened together by simple buckling means. Such simple buckling means could only be opened at one side but it is not possible to open at both sides. It is therefore very inconvenient for users.

BRIEF SUMMARY OF THE INVENTION

An object of the present invention is to provide a thermal box which could be opened at both sides and is convenient to use.

To attain this, the present invention adopts the following technical scheme:

A thermal box comprising a body; the body comprises a box body with an opening at a top portion thereof; a box cover for closing the opening, and locking devices for locking the box body and the box cover together; each of the locking devices comprises a snap fastening member and a snap fastening seat for receiving the snap fastening member; the snap fastening member is in block form; the locking devices are provided on a front side and a rear side of the body respectively; receiving recesses each having an open top end are recessed inwards from a front side wall and a rear side wall of the box body corresponding to the locking devices; for each of the locking devices, the snap fastening member and the snap fastening seat are both received in the corresponding receiving recess; the snap fastening seat is positioned at an inner side of the snap fastening member; the snap fastening seat is fixed on the box body; two extended lugs which are spaced apart left and right extend downwards from a bottom side of the box cover via the open top end of the receiving recess into the receiving recess; the snap fastening seat is provided with a pivot seat between the two extended lugs; the snap fastening member has an inner side which faces towards the snap fastening seat; two mounting lugs which are spaced apart left and right are provided on a top side of the snap fastening member; the two extended lugs are positioned between the two mounting lugs; the two extended lugs and the two mounting lugs are interconnected via a rotating shaft to rotate inwards and outwards in the receiving recess; a rotating shaft mounting recess which extends along left and right sides of the pivot seat is recessed downwards from a top side of the pivot seat; the rotating shaft is rotatably mounted inside the rotating shaft mounting recess; a fastening structure which fastens by pressing inwards and unfastens by pulling outwards is provided on the inner side of the snap fastening member and the snap fastening seat.

Each of the snap fastening seat comprises an upper horizontal member at the top end of the corresponding receiving recess, a lower horizontal member below the upper horizontal member, and a vertical member connected between the upper horizontal member and the lower horizontal member; the upper horizontal member and the lower horizontal member are both in elongated block form; the horizontal member has a top side which is in form of a sloping surface which slopes downwards; the corresponding extended lugs and the corresponding mounting lugs are all rested on an outer side of the top side of the upper horizontal member; each of the extended lugs has an inner surface in form of a bevel surface corresponding to the sloping surface; each of the extended lugs has a bottom side which is in convex curve shape; each of the mounting lugs has an inner surface which is in convex curve shape corresponding to the sloping surface of the upper horizontal member; the inner surfaces of the mounting lugs and the inner surfaces of the extended lugs are both spaced apart from the sloping surface of the upper horizontal member; an upper portion of the pivot seat is disposed on the sloping surface, and the upper portion of the pivot seat correspondingly slopes downwards; a lower portion of the pivot seat is provided on an outer side of the upper horizontal member and an outer side of the vertical member; a curved protrusion protrudes upwards from the top side of the pivot seat; the curved protrusion is positioned above an inner side of the rotating shaft mounting recess adjacent to a recess opening of the rotating shaft mounting recess.

For each of the snap fastening members, an indentation is recessed downwards between the two mounting lugs at the top side of the snap fastening member; two rotating shaft blocks which are spaced apart left and right are provided inside the indentation; a wheel positioned horizontally is provided between the two rotating shaft blocks; the wheel is connected to the two rotating shaft blocks via a wheel shaft; two rotating shaft insertion holes are provided on the snap fastening member at a left side and a right side of the indentation, each of which has a first end which communicates with the indentation and a second end which opens on a side wall of the snap fastening member; two guiding blocks extend downwards from a left side and a right side of a bottom side of the pivot seat; the guiding block which is on the left side is tightly engaged between the rotating shaft block on the left side and a left side wall of the indentation; the guiding block which is on the right side is tightly engaged between the rotating shaft block on the right side and a right side wall of the indentation; a through-hole is provided on each of the guiding blocks which corresponds in position to the rotating shaft insertion holes and extends through a left side and a right side of the guiding block; an outer side and the bottom side of the pivot seat are both in curve shape for guiding the wheel to slide thereon.

A pressing member which presses against a top side of the lower horizontal member and a hooking member which is hooked fastened on a bottom side of the lower horizontal member protrude from an inner surface of each of the snap fastening members; the top side of the lower horizontal member is in form of a sloping surface which slopes downwards from in to out; the pressing member has a lower bottom side which is in form of a sloping surface which correspondingly slopes downwards from out to in; the pressing member, the hooking member and the lower horizontal member form the fastening structure.

A self-locking hooking assembly is provided on each of the snap fastening members 4 and each of the lower horizontal members to limit the snap fastening member from springing outwards automatically.

Each of the self-locking hooking assemblies comprises a hook body and a spring; the hook body has an L-shaped structure with a vertical portion and a horizontal portion; the horizontal portion is positioned at an inner side of a lower portion of the vertical portion; the snap fastening member is provided with a mounting window which extends through a front and a rear side thereof; the hook body is rotatably mounted in the mounting window in an up and down rotatable manner via a rotating shaft; mounting blocks which are spaced apart left and right are provided on the inner side of the vertical portion for the rotating shaft to pass through; the spring is sleeved around the rotating shaft and positioned between the two mounting blocks; the spring has a first arm which faces upwards and a second arm which faces downwards; the first arm of the spring rests against the inner side of the vertical portion; the second arm of the spring protrudes downwards from the horizontal portion; an inward groove is recessed downwards from a lower bottom side of the mounting window; an end of the second arm of the spring inserts into the inward groove and translates inwards and outwards in the inward groove; a hook mouth protrudes upwards from an upper surface of an inner end portion of the horizontal portion; a hook portion is provided at the bottom side of the lower horizontal member for the hook mouth to hook on; a hook guiding sloping surface is provided on the hook portion for the hook mouth to slide from out to in across the hook portion to an inner side of the hook portion to hook with the hook portion; an unhook guiding sloping surface is provided on the hook portion for the hook mouth to slide from in to out across the hook portion to an outer side of the hook portion to unhook from the hook portion.

A pressing groove is recessed inwards from an upper portion of an outer surface of the vertical portion for a user's thumb to press thereon.

In the thermal box of the present invention, when in use, the locking devices at the front side and the rear side of the body are used to lock the box cover and the box body on two sides. The locking effect is good and it is difficult for the box cover to be disengaged during transportation. To open the box cover, it is only required to operate the locking means on either side of the body. During operation, pull the snap fastening member outwards to disengage the snap fastening member from the snap fastening seat and lift the box cover upwards. At this time, with the locking devices at the rear side of the body, rotation of the box cover and the rotating shaft allows the rear side of the box cover to rotate around the rotating shaft when the front side of the box cover is lifted upwards, so that the box cover and the box body are open at a non-disengaging state, thereby achieving bi-directional opening and avoiding inconvenience of conventional thermal boxes which could only be opened on one side. Besides, when the locking devices at the two sides are opened at the same time, the rotating shaft mounting recess at the top side of the pivot seat allows the rotating shaft to be lifted upwards and removed from the pivot seat, so that the box cover may be lifted upwards and disengaged completely from the box body. It is therefore more convenient to use.

DETAILED DESCRIPTION OF THE INVENTION

Figure 1:
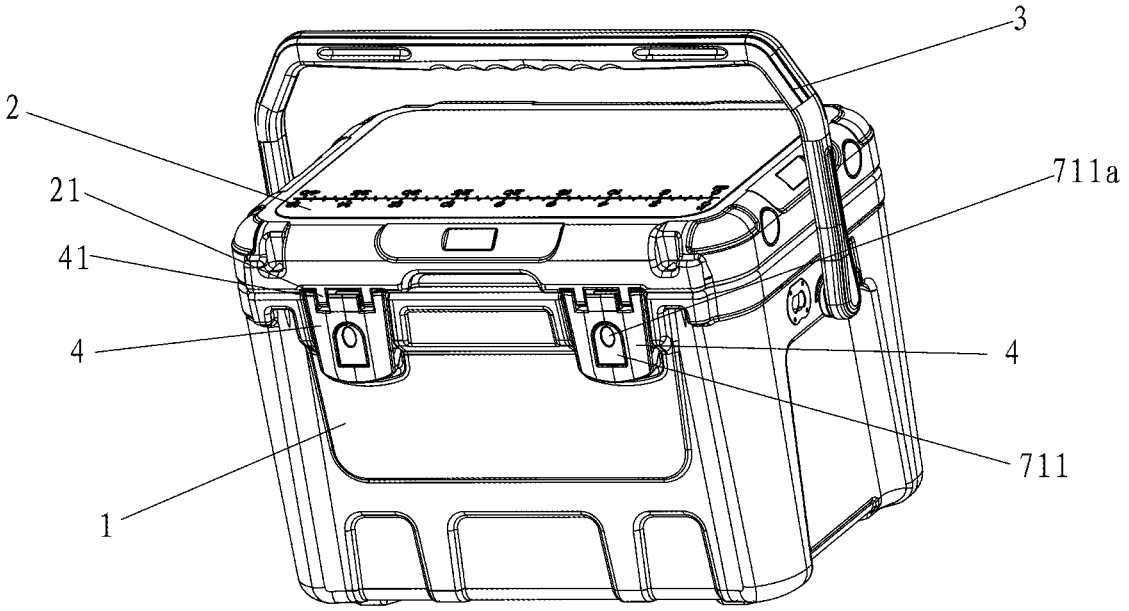
FIG. 1 is a perspective view of the present invention.
Figure 2:
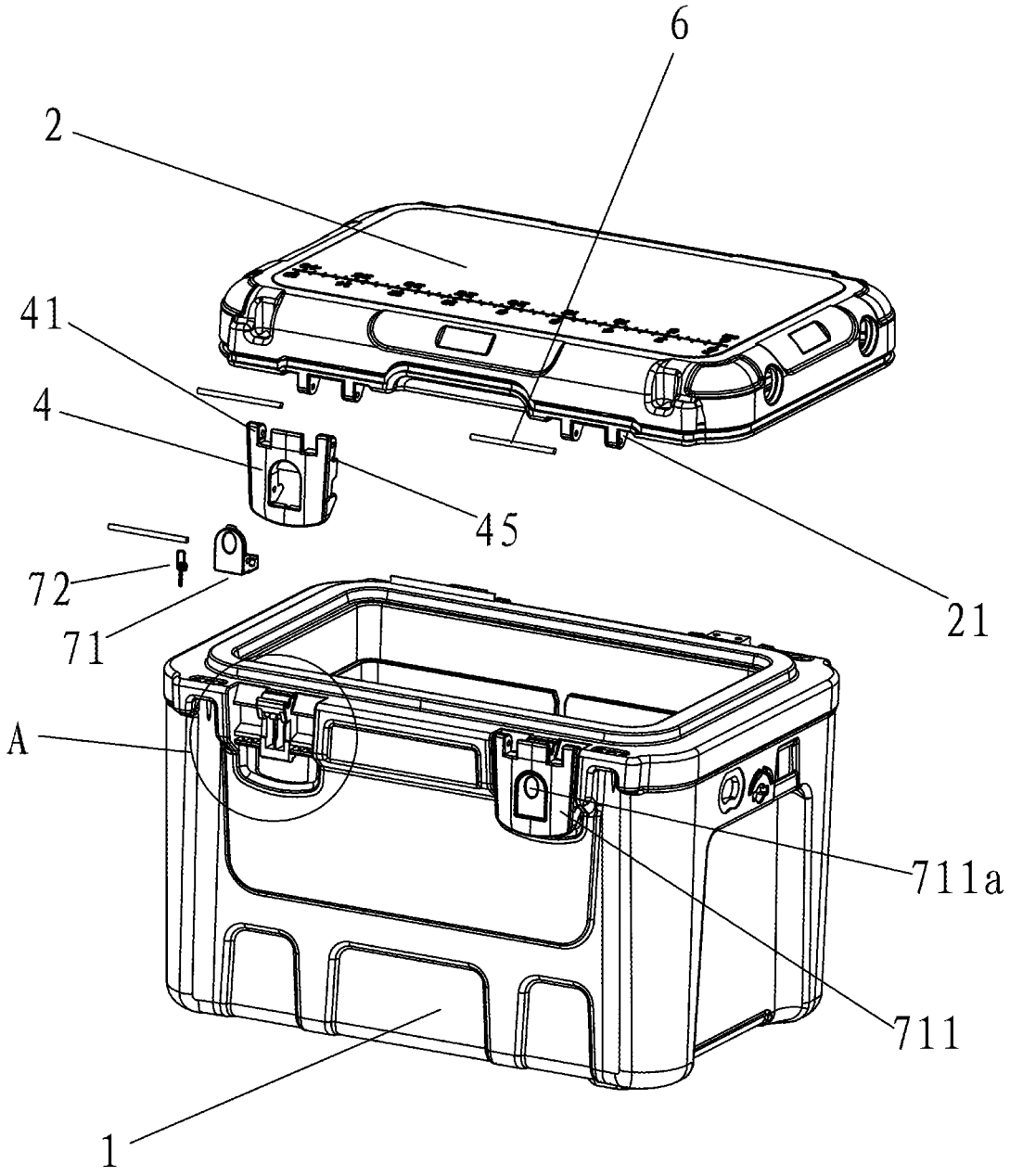
FIG. 2 is a partial disassembling view of the present invention.
Figure 3:
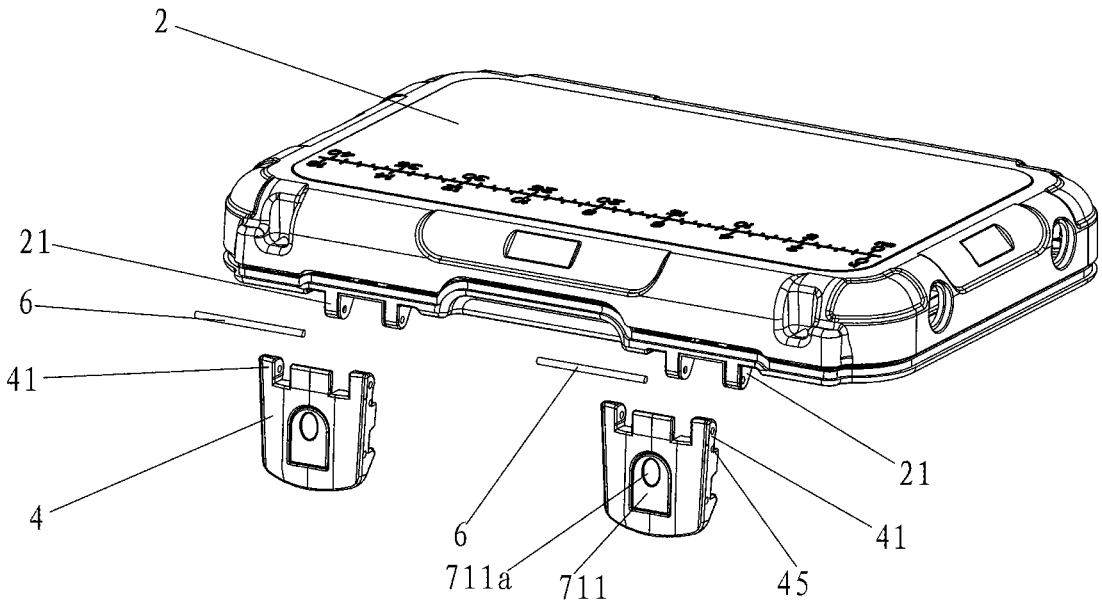
FIG. 3 is a disassembling view of the box cover and the snap fastening member.
Figure 4:
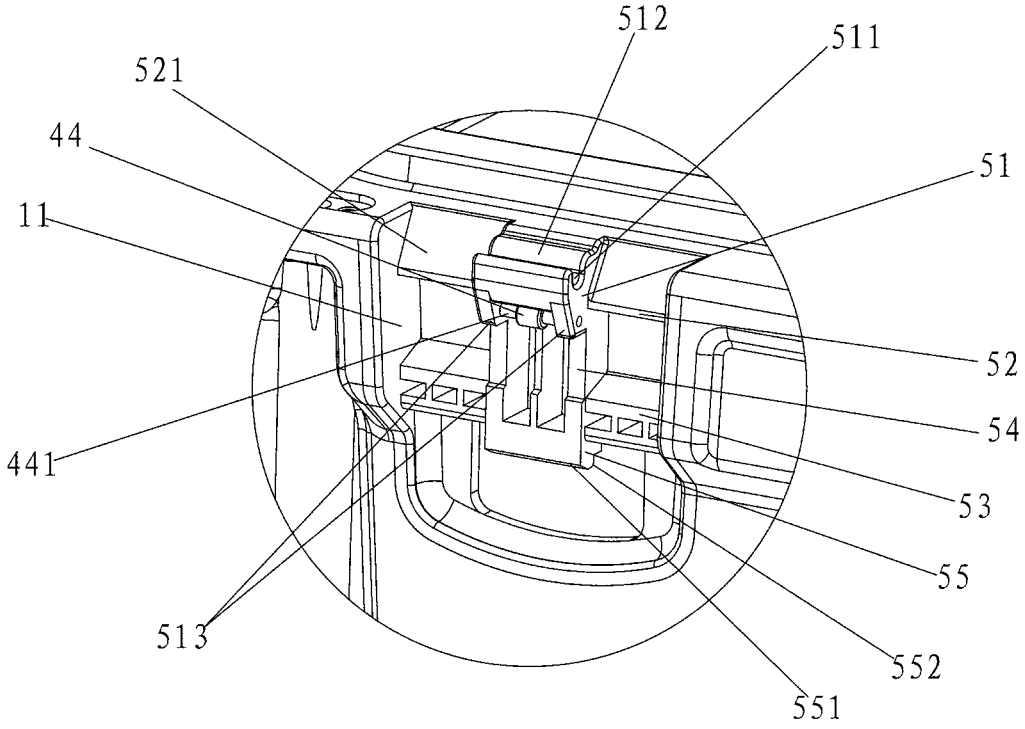
FIG. 4 is an enlarged view of the part marked "A" in FIG. 3.
Figure 5:
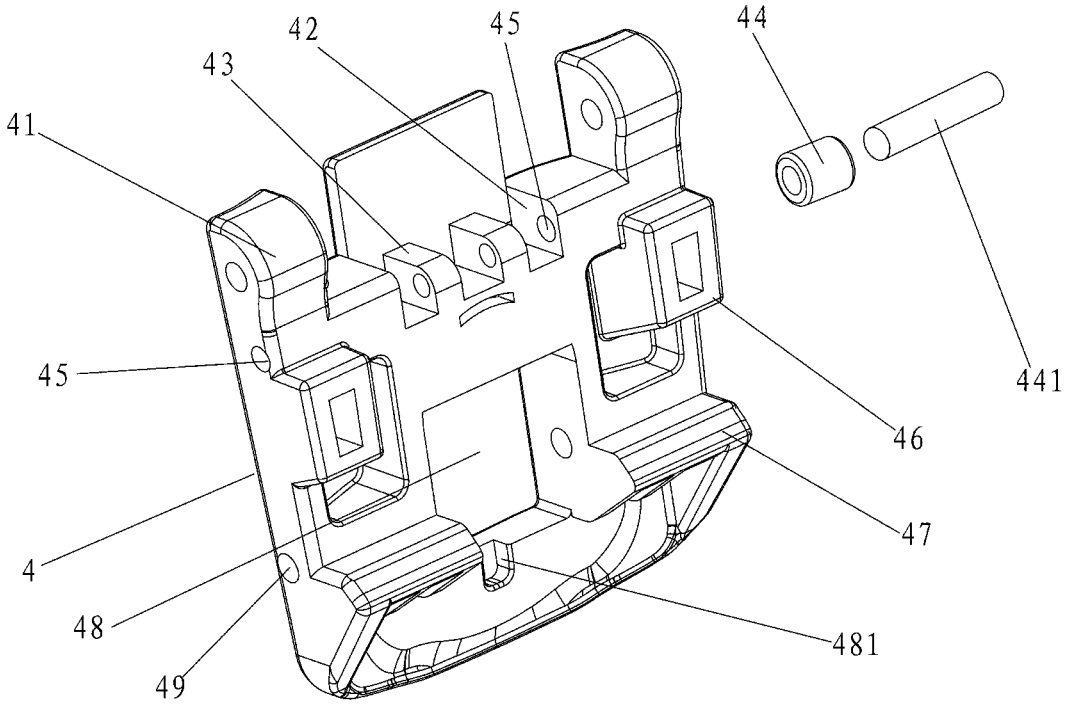
FIG. 5 is a perspective view of the snap fastening member.
Figure 6:
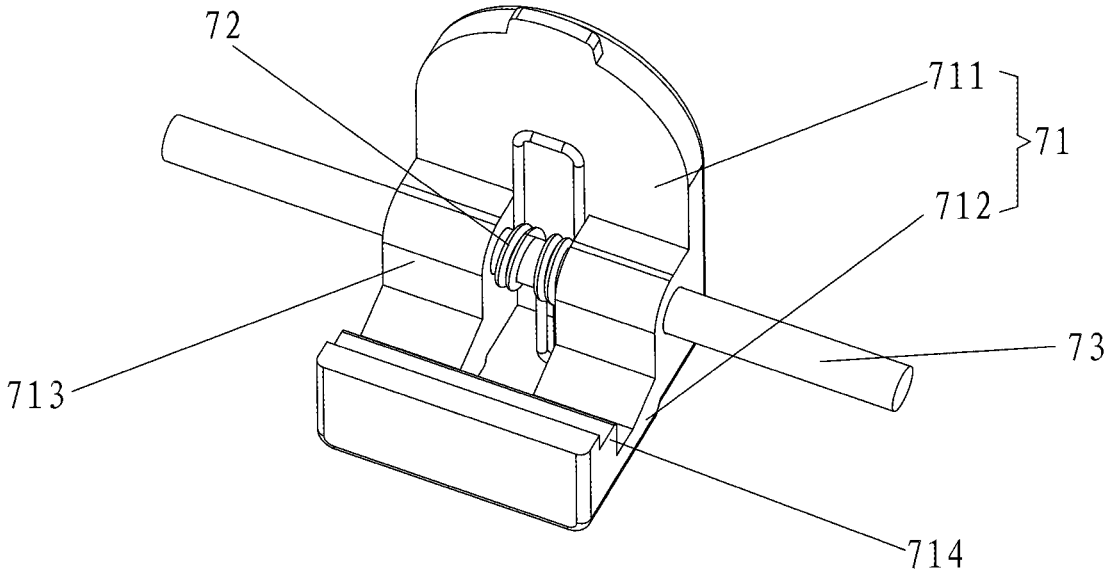
FIG. 6 is a perspective view of the self-locking hooking assembly.

As illustrated in FIGS. 1-6, the thermal box of the present invention comprises a body. The body comprises a box body 1 with an opening at a top portion thereof, a box cover 2 for closing the opening, locking devices for locking the box body 1 and the box cover 2 together, and a handle 3. The box body 1 has a structure which is the same as the box body structure for thermal box with hot or cold thermal effect. The box cover 2 also has a structure which is the same as the box cover structure for thermal box with hot or cold thermal effect. Two sides of the handle 3 are pivotally connected to two opposed outer side walls of the box body 1 respectively to achieve rotation of the handle 3.

The locking devices are disposed on a left side and a right side of a front side of the body, and on a left side and a right side of a rear side of the body respectively. Two arms of the handle 3 are movably and pivotally connected to a left outer side wall and a right outer side wall of the box body 1 respectively. Left sides and right sides of both the box body 1 and the box cover 2 are correspondingly connected by non-locking connecting means. Each of the locking devices comprise a snap fastening member 4 and a snap fastening seat for receiving the snap fastening member. The snap fastening member 4 is in block form. Receiving recesses 11 are recessed inwards from a front side and a rear side of the box body 1 corresponding to the locking devices. Notches which communicate with the receiving recesses 11 are provided on a top side of the box body 1 corresponding to the receiving recesses 11 so that the receiving recesses 11 are open at top ends thereof. The snap fastening member 4 and the snap fastening seat are both received in the receiving recess 11. The snap fastening seat is positioned at an inner side of the snap fastening member 4. The snap fastening seat fixed on the box body 1 and is integrally formed with the box body 1. Two extended lugs 21 extend downwards from a bottom side of the box cover 2 via the notches at the top ends of each of the receiving recesses 11 into each of the receiving recesses 11, and the two extended lugs 21 are spaced apart left and right. Each of the snap fastening seats is provided with a pivot seat 51 between the two extended lugs 21. Each of the snap fastening members 4 has an inner side which faces towards the snap fastening seat. Two mounting lugs 41 which are spaced apart left and right are provided on a top side of the snap fastening member 4. The two extended lugs 21 are positioned between the two mounting lugs 41. The two extended lugs 21 and the two mounting lugs 41 are interconnected via a rotating shaft 6, and the two extended lugs 21 and the two mounting lugs 41 may rotate with respect to each other around the rotating shaft 6 inside the receiving recess 11; therefore, the box cover 2 and the snap fastening member 4 may rotate up and down around the rotating shaft 6 respectively to open. A rotating shaft mounting recess 511 which extends along left and right sides of the pivot seat 51 is recessed downwards from a top side of the pivot seat 51. The rotating shaft 6 is rotatably mounted inside the rotating shaft mounting recess 511. A fastening structure which fastens by pressing inwards and unfastens by pulling outwards is provided on the inner side of the snap fastening member 4 and the snap fastening seat.

More specifically, the snap fastening seat comprises an upper horizontal member 52 at the top end of the receiving recess 11, a lower horizontal member 53 below the upper horizontal member 52, and a vertical member 54 connected between the upper horizontal member 52 and the lower horizontal member 53. The upper horizontal member 52 and the lower horizontal member 53 are both in elongated block form. The upper horizontal member 52 has a top side which is in form of a sloping surface 521 which slopes downwards. The extended lugs 21 and the mounting lugs 41 are all rested on an outer side of the top side of the upper horizontal member 52. Each of the extended lugs 21 has an inner surface in form of a bevel surface corresponding to the sloping surface 521. Each of the extended lugs has a bottom side which is in convex curve shape. Each of the mounting lugs 41 has an inner surface which is in convex curve shape corresponding to the sloping surface of the upper horizontal member 52. The inner surfaces of the mounting lugs 41 and the inner surfaces of the extended lugs 21 are both spaced apart from the sloping surface 521 of the upper horizontal member; the aforementioned spacing allows the mounting lugs and the extended lugs to rotate around the rotating shaft 6 in the receiving recess 11, and the cooperation between the sloping surface and the convex curve shape could have guiding effect on the rotation of the mounting lugs and the extended lugs, so that rotation of the mounting lugs and the extended lugs is smoother.

An upper portion of the pivot seat 51 is disposed on the sloping surface 521, and the upper portion of the pivot seat 51 correspondingly slopes downwards. A lower portion of the pivot seat 51 is provided on an outer side of the upper horizontal member 52 and an outer side of the vertical member 53. A curved protrusion 512 protrudes upwards from the top side of the pivot seat 51. The curved protrusion 512 is positioned above an inner side of the rotating shaft mounting recess 511 adjacent to a recess opening of the rotating shaft mounting recess. The curved protrusion 512 facilitates the rotating shaft 6 to slide into the rotating shaft mounting recess 511 and leave the rotating shaft mounting recess 511, thus guide the opening and closing of the box cover.

An indentation 42 is recessed downwards between the two mounting lugs 41 at the top side of each of the snap fastening members 4. Two rotating shaft blocks 43 which are spaced apart left and right are provided inside the indentation 42. A wheel 44 positioned horizontally is provided between the two rotating shaft blocks 43. The wheel 44 is connected to the two rotating shaft blocks 43 via a wheel shaft 441. Two rotating shaft insertion holes 45 are provided on the snap fastening member 4 at a left side and a right side of the indentation 42, each of which has a first end which communicates with the indentation 42 and a second end which opens on a side wall of the snap fastening member. The rotating shaft insertion holes 45 facilitate disassembly and assembly of the wheel 44 and the wheel shaft 441. Two guiding blocks 513 extend downwards from a left side and a right side of a bottom side of the pivot seat 51. The guiding block 513 which is on the left side is tightly engaged between the rotating shaft block 43 on the left side and a left side wall of the indentation 42. The guiding block 513 which is on the right side is tightly engaged between the rotating shaft block 43 on the right side and a right side wall of the indentation 42. A through-hole is provided on each of the guiding blocks 53 which corresponds in position to the rotating shaft insertion holes and extends through a left side and a right side of the guiding block. An outer side and the bottom side of the pivot seat 51 are both in curve shape for guiding the wheel 44 to slide thereon.

A pressing member 46 which presses against a top side of the lower horizontal member 53 and a hooking member 47 which is hooked fastened on a bottom side of the lower horizontal member 53 protrude from an inner surface of each of the snap fastening members 4. The top side of the lower horizontal member 53 is in form of a sloping surface which slopes downwards from in to out. In other words, the top side has a top end at an inner side and a bottom end at an outer side. Correspondingly, the pressing member 46 has a lower bottom side which is in form of a sloping surface which slopes downwards from out to in. In other words, the lower bottom side of the pressing member has a top end at an outer side and a bottom end at an inner side. The sloping surfaces serve to guide the fastening of the lower horizontal member 42 with the pressing member and the hooking member. The pressing member, the hooking member and the lower horizontal member form the fastening structure. Such fastening structure is a common structure and the details are not repeated herein.

In the thermal box of the present invention, to lock the box, the two locking devices on each of the front side and the rear side of the body are used to lock the box cover and the box body on two sides. The locking effect is good and it is difficult for the box cover to be disengaged during transportation. To open the box, it is only required to operate the two locking devices on the front side of the body. During operation, pull the lower portion of the snap fastening member 4 outwards; the upper portion of the snap fastening member 4 rotates inwards via the rotating shaft 6; the outward rotation of the lower portion of the snap fastening member 4 causes the lower horizontal member 53 to disengage from the space between the pressing member 46 and the hooking member 47; the snap fastening member 4 is partially released; at this time, the wheel 44 of the snap fastening member 4 slides outwards and upwards along the curved surface of the pivot seat 51 to the outer side of the pivot seat 51 together with the snap fastening member 4; the recess opening of the rotating shaft mounting recess 511 allows the rotating shaft 6 to disengage from the recess opening; the snap fastening member 4 is released completely. The box body 1 and the box cover 2 are separated completely. The box cover 2 may be opened upwards. At the same time, with the locking devices on the rear side of the body, rotation of the box cover 2 and the rotating shaft 6 allows the rear side of the box cover 2 to rotate around the rotating shaft 6 when the front side of the box cover 2 is lifted upwards, so that the box cover and the box body are open at a non-disengaging state. To close the box, the rotating shaft 6 is inserted into the rotating shaft mounting recess 511, and the snap fastening member 4 is pressed outwards. At this time, the wheel 44 is guided to slide along the curved surface of the pivot seat 51 in-between the two guiding blocks 513 to get in place. The lower horizontal member 53 is correspondingly engaged between the pressing member 46 and the hooking member 47. The snap fastening member 4 is fastened. In this way, the wheel 44 serves guiding and facilitating effects on the outward and inward movement of the snap fastening member 4, so that opening and closing of the box cover is easier and smoother. Besides, the combination of the wheel 44, the guiding blocks 513 and the rotating shaft blocks 43 serves fixing effect to prevent the snap fastening member 4 from disengaging automatically. Accordingly, it is only required to operate the locking devices on the rear side of the body to open the rear side of the box cover without operating the two locking devices on the front side of the body, thereby achieving bi-directional opening and avoiding inconvenience of conventional thermal boxes which could only be opened on one side. Besides, when the locking devices on the front and rear sides of the body are opened at the same time, the box cover 2 may be lifted upwards to be disengaged completely from the box body 1. It is therefore more convenient to use.

Preferably, a self-locking hooking assembly is provided on the snap fastening member 4 and the lower horizontal member 53 to limit the snap fastening member 4 from springing outwards automatically. The self-locking hooking assembly comprises a hook body 71 and a spring 72. The hook body 71 has an L-shaped structure with a vertical portion 711 and a horizontal portion 712. The horizontal portion 712 is positioned at an inner side of a lower portion of the vertical portion 711. The snap fastening member 4 is provided with a mounting window 48 which extends through a front and a rear side thereof. The hook body 71 is rotatably mounted in the mounting window 48 in an up and down rotatable manner via a rotating shaft 73. Mounting blocks 713 which are spaced apart left and right are provided on the inner side of the vertical portion 711. The rotating shaft 73 passes through the two mounting blocks 713. Through-holes 49 are provided on left and right sides of the snap fastening member 4 corresponding to the mounting window 48 for the rotating shaft 73 to enter from outside of the snap fastening member 4 into the mounting window 48. The spring 72 is sleeved around the rotating shaft 73 and positioned between the two mounting blocks 713. The assembly and disassembly of the spring 72 is achieved by the two through-holes 49. The spring 72 has a first arm which faces upwards and a second arm which faces downwards. The first arm of the spring rests against the inner side of the vertical portion 711. The second arm of the spring 72 protrudes downwards from the horizontal portion 712. An inward groove 481 is recessed downwards from a lower bottom side of the mounting window 48. An end of the second arm of the spring 72 is embedded in the inward groove and is slidable inwards and outwards inside the inward groove. A hook mouth 714 protrudes upwards from an upper surface of an inner end portion of the horizontal portion 712. A hook portion 55 is provided at the bottom side of the lower horizontal member 53 for the hook mouth 714 to hook on. A hook guiding sloping surface 551 is provided on the hook portion 55 for the hook mouth 714 to slide from out to in across the hook portion 55 to an inner side of the hook portion 55 to hook with the hook portion. An unhook guiding sloping surface 552 is provided on the hook portion for the hook mouth 714 to slide from in to out across the hook portion to an outer side of the hook portion to unhook from the hook portion. In other words, the hook mouth 714 makes use of the hook guiding sloping surface 551 to slide from out to in to the inner side of the hook portion 55 to hook with the hook portion 55; during unhook, the hook mouth 714 is pulled outwards and the hook mouth 714 then makes use of the unhook guiding sloping surface 552 to slide from in to out outside the hook portion 55 to unhook from the hook portion 55. Such unhooking means is a relatively common fastening means for plastic parts. With the aforementioned self-locking hooking assembly, when the user pulls the lower portion of the snap fastening member 4 outwards, his thumb simultaneously presses inwards on the upper portion of the vertical portion 711; by leverage principle, the lower portion of the vertical portion 711 rotates outwards, the hook mouth 714 slides outwards to unhook from the hook portion 55, the first arm of the spring 72 is pressed inwards, the second arm of the spring 72 simultaneously generates outward elastic force to facilitate the hook mouth 714 to unhook from the hook portion 55, so that opening of the box cover is more effort-saving; then, the second arm of the spring 72 brings the hook mouth 714 to reset to initial state. To close the box cover, the lower portion of the vertical portion 711 is pressed inwards; under the force of the second arm of the spring 72, the hook mouth 714 is tightly hooked with the hook portion 55 to achieve self-locking. The box body and the box cover are therefore locked by double means, and thus the locking effect is better.

Moreover, a pressing groove 711*a* is recessed inwards from an upper portion of an outer surface of the vertical portion 711 for the user's thumb to press thereon. The pressing groove 711*a* therefore facilitates the user to operate the hook body 71.

What is claimed is:

1. A thermal box comprising a body; the body comprises a box body with an opening at a top portion thereof; a box cover for closing the opening, and locking devices for locking the box body and the box cover together; each of the locking devices comprises a snap fastening member and a snap fastening seat for receiving the snap fastening member; the snap fastening member is in block form;

characterized in that:

the locking devices are provided on a front side and a rear side of the body respectively; receiving recesses each having an open top end are recessed inwards from a front side wall and a rear side wall of the box body corresponding to the locking devices;

for each of the locking devices, the snap fastening member and the snap fastening seat are both received in the corresponding receiving recess; the snap fastening seat is positioned at an inner side of the snap fastening member; the snap fastening seat is fixed on the box body; two extended lugs which are spaced apart left and right extend downwards from a bottom side of the box cover via the open top end of the receiving recess into the receiving recess; the snap fastening seat is provided with a pivot seat between the two extended lugs; the snap fastening member has an inner side which faces towards the snap fastening seat; two mounting lugs which are spaced apart left and right are provided on a top side of the snap fastening member; the two extended lugs are positioned between the two mounting lugs; the two extended lugs and the two mounting lugs are interconnected via a rotating shaft to rotate inwards and outwards in the receiving recess; a rotating shaft mounting recess which extends along left and right sides of the pivot seat is recessed downwards from a top side of the pivot seat; the rotating shaft is rotatably mounted inside the rotating shaft mounting recess; a fastening structure which fastens by pressing inwards and unfastens by pulling outwards is provided on the inner side of the snap fastening member and the snap fastening seat.

2. The thermal box as in claim 1, characterized in that: each of the snap fastening seat comprises an upper horizontal member at the top end of the corresponding receiving recess, a lower horizontal member below the upper horizontal member, and a vertical member connected between the upper horizontal member and the lower horizontal member; the upper horizontal member and the lower horizontal member are both in elongated block form; the horizontal member has a top side which is in form of a sloping surface which slopes downwards; the corresponding extended lugs and the corresponding mounting lugs are all rested on an outer side of the top side of the upper horizontal member; each of the extended lugs has an inner surface in form of a bevel surface corresponding to the sloping surface; each of the extended lugs has a bottom side which is in convex curve shape; each of the mounting lugs has an inner surface which is in convex curve shape corresponding to the sloping surface of the upper horizontal member; the inner surfaces of the mounting lugs and the inner surfaces of the extended lugs are both spaced apart from the sloping surface of the upper horizontal member; an upper portion of the pivot seat is disposed on the sloping surface, and the upper portion of the pivot seat correspondingly slopes downwards; a lower portion of the pivot seat is provided on an outer side of the upper horizontal member and an outer side of the vertical member; a curved protrusion protrudes upwards from the top side of the pivot seat; the curved protrusion is positioned above an inner side of the rotating shaft mounting recess adjacent to a recess opening of the rotating shaft mounting recess.

3. The thermal box as in claim 1, characterized in that: for each of the snap fastening members, an indentation is recessed downwards between the two mounting lugs at the top side of the snap fastening member; two rotating shaft blocks which are spaced apart left and right are provided inside the indentation; a wheel positioned horizontally is provided between the two rotating shaft blocks; the wheel is connected to the two rotating shaft blocks via a wheel shaft; two rotating shaft insertion holes are provided on the snap fastening member at a left side and a right side of the indentation, each of which has a first end which communicates with the indentation and a second end which opens on a side wall of the snap fastening member; two guiding blocks extend downwards from a left side and a right side of a bottom side of the pivot seat; the guiding block which is on the left side is tightly engaged between the rotating shaft block on the left side and a left side wall of the indentation; the guiding block which is on the right side is tightly engaged between the rotating shaft block on the right side and a right side wall of the indentation; a through-hole is provided on each of the guiding blocks which corresponds in position to the rotating shaft insertion holes and extends through a left side and a right side of the guiding block; an outer side and the bottom side of the pivot seat are both in curve shape for guiding the wheel to slide thereon.

4. The thermal box as in claim 2, characterized in that: a pressing member which presses against a top side of the lower horizontal member and a hooking member which is hooked fastened on a bottom side of the lower horizontal member protrude from an inner surface of each of the snap fastening members; the top side of the lower horizontal member is in form of a sloping surface which slopes downwards from in to out; the pressing member has a lower bottom side which is in form of a sloping surface which correspondingly slopes downwards from out to in; the pressing member, the hooking member and the lower horizontal member form the fastening structure.

5. The thermal box as in claim 4, characterized in that: a self-locking hooking assembly is provided on each of the snap fastening members and each of the lower horizontal members to limit the snap fastening member from springing outwards automatically.

6. The thermal box as in claim 5, characterized in that: each of the self-locking hooking assemblies comprises a hook body and a spring; the hook body has an L-shaped structure with a vertical portion and a horizontal portion; the horizontal portion is positioned at an inner side of a lower portion of the vertical portion; the snap fastening member is provided with a mounting window which extends through a front and a rear side thereof; the hook body is rotatably mounted in the mounting window in an up and down rotatable manner via a rotating shaft; mounting blocks which are spaced apart left and right are provided on the inner side of the vertical portion for the rotating shaft to pass through; the spring is sleeved around the rotating shaft and positioned between the two mounting blocks; the spring has a first arm which faces upwards and a second arm which faces downwards; the first arm of the spring rests against the inner side of the vertical portion; the second arm of the spring protrudes downwards from the horizontal portion; an inward groove is recessed downwards from a lower bottom side of the mounting window; an end of the second arm of the spring inserts into the inward groove and translates inwards and outwards in the inward groove; a hook mouth protrudes upwards from an upper surface of an inner end portion of the horizontal portion; a hook portion is provided at the bottom side of the lower horizontal member for the hook mouth to hook on; a hook guiding sloping surface is provided on the hook portion for the hook mouth to slide from out to in across the hook portion to an inner side of the hook portion to hook with the hook portion; an unhook guiding sloping surface is provided on the hook portion for the hook mouth to slide from in to out across the hook portion to an outer side of the hook portion to unhook from the hook portion.

7. The thermal box as in claim 6, characterized in that: a pressing groove is recessed inwards from an upper portion of an outer surface of the vertical portion for a user's thumb to press thereon.

* * * * *